US011293168B2

(12) United States Patent
Kenkel et al.

(10) Patent No.: US 11,293,168 B2
(45) **Date of Patent: *Apr. 5, 2022**

(54) METHOD OF LIMITING FLOW THROUGH ACCELEROMETER FEEDBACK

(71) Applicant: Deere & Company, Moline, IL (US)

(72) Inventors: Aaron R. Kenkel, East Dubuque, IL (US); Grant R. Henn, Dubuque, IA (US); Doug M. Lehmann, Centralia, IA (US)

(73) Assignee: DEERE & COMPANY, Moline, IL (US)

( * ) Notice: Subject to any disclaimer, the term of this patent is extended or adjusted under 35 U.S.C. 154(b) by 534 days.

This patent is subject to a terminal disclaimer.

(21) Appl. No.: 15/908,574

(22) Filed: Feb. 28, 2018

(65) Prior Publication Data

US 2019/0264423 A1 Aug. 29, 2019

(51) Int. Cl.
*E02F 3/42* (2006.01)
*E02F 9/22* (2006.01)
(Continued)

(52) U.S. Cl.
CPC ..... *E02F 9/2228* (2013.01); *E02F 3/283* (2013.01); *E02F 3/422* (2013.01); *E02F 9/2267* (2013.01); *E02F 9/2271* (2013.01); *E02F 3/342* (2013.01)

(58) Field of Classification Search
CPC . E02F 3/283; E02F 3/342; E02F 3/422; E02F 9/2228; E02F 9/26; E02F 9/264
See application file for complete search history.

(56) References Cited

U.S. PATENT DOCUMENTS 5,180,028 A 1/1993 Perrenoud, Jr.
5,692,376 A 12/1997 Miki et al.
(Continued)

FOREIGN PATENT DOCUMENTS

CN 103026076 A 4/2013
CN 103403271 A 11/2013
(Continued)

OTHER PUBLICATIONS

U.S. Appl. No. 16/182,106, filed Nov. 6, 2018, by Myers et al.
(Continued)

*Primary Examiner* — Hunter B Lonsberry
*Assistant Examiner* — Matthew J. Reda
(74) *Attorney, Agent, or Firm* — Michael Best & Friedrich LLP

(57) ABSTRACT

A control system for a material handling vehicle has a boom arm connected to a vehicle frame for rotation about the vehicle frame. An actuator is connected to the vehicle frame and the boom arm to cause the boom arm to rotate about the vehicle frame, and an attachment is connected to the boom arm for rotation with respect to the boom arm. The control system includes a controller that is configured to calculate a pre-determined acceleration limit of the attachment, and a sensor that senses acceleration of the attachment and communicate the sensed acceleration to the controller. The controller is configured to compare the pre-determined acceleration limit of the attachment to the sensed acceleration of the attachment and is configured to adjust a control valve to limit flow to the actuator in response to the sensed acceleration of the attachment being above the pre-determined acceleration upper limit.

18 Claims, 12 Drawing Sheets

(51) Int. Cl.
*E02F 3/28* (2006.01)
*E02F 3/342* (2006.01)

(56) References Cited

U.S. PATENT DOCUMENTS

| | | | | |
|---|---|---|---|---|
| 6,047,228 | A | 4/2000 | Stone et al. | |
| 6,175,796 | B1 | 1/2001 | Ishikawa | |
| 6,437,701 | B1 | 8/2002 | Muller | |
| 6,552,279 | B1 | 4/2003 | Lueschow | |
| 6,615,581 | B2 | 9/2003 | Kusuyama | |
| 6,802,687 | B2 | 10/2004 | Litchfield et al. | |
| 6,868,672 | B2 | 3/2005 | Luo | |
| 7,276,669 | B2 | 10/2007 | Dahl et al. | |
| 7,518,523 | B2 | 4/2009 | Yuan et al. | |
| 7,610,136 | B2 | 10/2009 | Okamura et al. | |
| 7,630,793 | B2 | 12/2009 | Thomas et al. | |
| 8,751,117 | B2 | 6/2014 | Ekvall et al. | |
| 9,068,323 | B2 | 6/2015 | Peterson et al. | |
| 9,074,352 | B2 | 7/2015 | Ramun | |
| 9,206,026 | B2 | 12/2015 | Aulton et al. | |
| 9,238,903 | B2 | 1/2016 | Saito | |
| 9,593,461 | B2 | 3/2017 | Faivre et al. | |
| 9,822,507 | B2 | 11/2017 | Singh et al. | |
| 2006/0108185 | A1 | 5/2006 | Bitter | |
| 2008/0201043 | A1 | 8/2008 | Sahlin et al. | |
| 2008/0234902 | A1 | 9/2008 | Johnson et al. | |
| 2009/0082930 | A1 | 3/2009 | Peters | |
| 2009/0171482 | A1 | 7/2009 | Mindeman et al. | |
| 2010/0204891 | A1 | 8/2010 | Biggerstaff | |
| 2010/0268410 | A1 | 10/2010 | Vigholm et al. | |
| 2011/0046857 | A1 | 2/2011 | Farmer et al. | |
| 2012/0291427 | A1 | 11/2012 | Azuma et al. | |
| 2013/0226415 | A1* | 8/2013 | Smith | E02F 9/2235 701/50 |
| 2013/0228070 | A1 | 9/2013 | Kim | |
| 2013/0318952 | A1 | 12/2013 | Park et al. | |
| 2013/0345939 | A1 | 12/2013 | Magaki et al. | |
| 2014/0088839 | A1 | 3/2014 | Magaki et al. | |
| 2014/0121840 | A1 | 5/2014 | Mizuochi et al. | |
| 2014/0320293 | A1 | 10/2014 | Hunter, Jr. et al. | |
| 2015/0368080 | A1* | 12/2015 | Dal Dosso | B66F 17/003 701/50 |
| 2016/0281323 | A1 | 9/2016 | Imaizumi | |
| 2016/0281331 | A1* | 9/2016 | Ikegami | E02F 9/2228 |
| 2016/0312432 | A1 | 10/2016 | Wang et al. | |
| 2017/0050643 | A1 | 2/2017 | Lambert | |
| 2017/0121929 | A1 | 5/2017 | Martinez | |
| 2017/0191245 | A1 | 7/2017 | Shatters et al. | |
| 2017/0211597 | A1 | 7/2017 | Vigholm et al. | |
| 2017/0284056 | A1* | 10/2017 | Mizuochi | E02F 3/32 |
| 2018/0087242 | A1 | 3/2018 | Mitchell et al. | |
| 2018/0327238 | A1 | 11/2018 | Tremblay | |
| 2019/0010965 | A1 | 1/2019 | Green et al. | |
| 2019/0024345 | A1 | 1/2019 | Thomsen et al. | |
| 2019/0264420 | A1* | 8/2019 | Henn | E02F 3/422 |
| 2019/0264422 | A1* | 8/2019 | Kenkel | E02F 3/422 |
| 2019/0264424 | A1* | 8/2019 | Lehmann | E02F 9/2029 |

FOREIGN PATENT DOCUMENTS

| | | | |
|---|---|---|---|
| CN | 105035776 | A | 11/2015 |
| CN | 106245706 | A | 12/2016 |
| CN | 107268702 | A | 10/2017 |
| DE | 19510375 | A1 | 9/1995 |
| DE | 19901563 | A1 | 7/2000 |
| DE | 10163066 | A1 | 7/2003 |
| DE | 102007045846 | A1 | 4/2009 |
| DE | 102008012301 | A1 | 9/2009 |
| DE | 112010003335 | T5 | 8/2012 |
| DE | 112012003346 | B4 | 1/2017 |
| EP | 0229083 | B1 | 7/1987 |
| EP | 1862599 | B1 | 7/2013 |
| JP | H03-8929 | A | 1/1991 |
| WO | 2014110336 | A1 | 7/2014 |
| WO | 2016152994 | A1 | 7/2017 |

OTHER PUBLICATIONS

U.S. Appl. No. 15/908,555, filed Feb. 28, 2018, by Myers et al.
U.S. Appl. No. 15/908,581, filed Feb. 28, 2018, by Henn et al.
U.S. Appl. No. 15/908,583, filed Feb. 28, 2018, by Lehmann et al.
U.S. Appl. No. 15/908,561, filed Feb. 28, 2018, by Kenkel et al.
U.S. Appl. No. 15/908,565, filed Feb. 28, 2018, by Myers et al.
German Patent Office Examination Report for Application No. 102019202746.6 dated Jan. 29, 2020 (11 pages, statement of relevance included).
German Patent Office Examination Report for Application No. 102019202654.0 dated Dec. 18, 2019 (11 pages, statement of relevance included).
German Patent Office Examination Report for Application No. 102019202754.7 dated Dec. 20, 2019 (11 pages, statement of relevance included).
German Search Report issued in counterpart application No. 102019202654.0 dated Dec. 18, 2019 (10 pages).
Hassan et al. "An Experimental Study Into The Effect Of Temperature And Pressure on The Hydraulic System" Eng & Tech. Journal, 2009, 27(14)12531-2545.

* cited by examiner

METHOD OF LIMITING FLOW THROUGH ACCELEROMETER FEEDBACK

BACKGROUND

The present disclosure relates to a material handling vehicle that is configured to move one or more attachments.

SUMMARY

In some embodiments, the disclosure provides a material handling vehicle that includes a vehicle frame and a boom arm having a first end and a second end. The boom arm is connected to the frame adjacent the first end for rotation with respect to the frame. An actuator is connected to the vehicle frame and the boom arm for moving the boom arm with respect to the frame, and an attachment is connected to the boom arm adjacent the second end of the boom arm. A fluid reservoir is fluidly connected to the actuator to control movement of the attachment, and a control system is configured to direct movement of the attachment in response to input from a user. A control valve is positioned between the fluid reservoir and the actuator to selectively limit flow to the attachment and to thereby control a speed of movement of the attachment, and an accelerometer is connected to the vehicle, is configured to sense an acceleration of the attachment, and to communicate the sensed acceleration to the control system. The control system is operable to compare the sensed acceleration to a pre-determined acceleration limit of the attachment, and the control system is operable to adjust the control valve to limit flow to the actuator in response to the sensed acceleration of the attachment being above a pre-determined acceleration upper limit.

In some embodiments the disclosure provides a method of controlling hydraulic fluid flow to an implement of a material handling vehicle. The method includes coupling a boom arm to a vehicle frame for rotation about the vehicle frame, rotating a boom arm with respect to the vehicle frame with an actuator, coupling an attachment to the boom arm for rotation with respect to the boom arm, sensing an acceleration of the attachment, communicating the sensed acceleration of the attachment to a control system, comparing the sensed acceleration to a pre-determined acceleration limit of the attachment, and limiting fluid flow to the actuator with a control valve in response to the sensed acceleration of the attachment being above a pre-determined acceleration upper limit.

In some embodiments, the disclosure provides a control system for a material handling vehicle that has a boom arm connected to a vehicle frame for rotation about the vehicle frame. An actuator is connected to the vehicle frame and the boom arm to cause the boom arm to rotate about the vehicle frame, and an attachment is connected to the boom arm for rotation with respect to the boom arm. The control system includes a controller that is configured to calculate a pre-determined acceleration limit of the attachment, and a sensor that senses acceleration of the attachment and communicate the sensed acceleration to the controller. The controller is configured to compare the pre-determined acceleration limit of the attachment to the sensed acceleration of the attachment and is configured to adjust a control valve to limit flow to the actuator in response to the sensed acceleration of the attachment being above the pre-determined acceleration upper limit.

Other aspects of the disclosure will become apparent by consideration of the detailed description and accompanying drawings.

Before any embodiments of the disclosure are explained in the detailed description in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
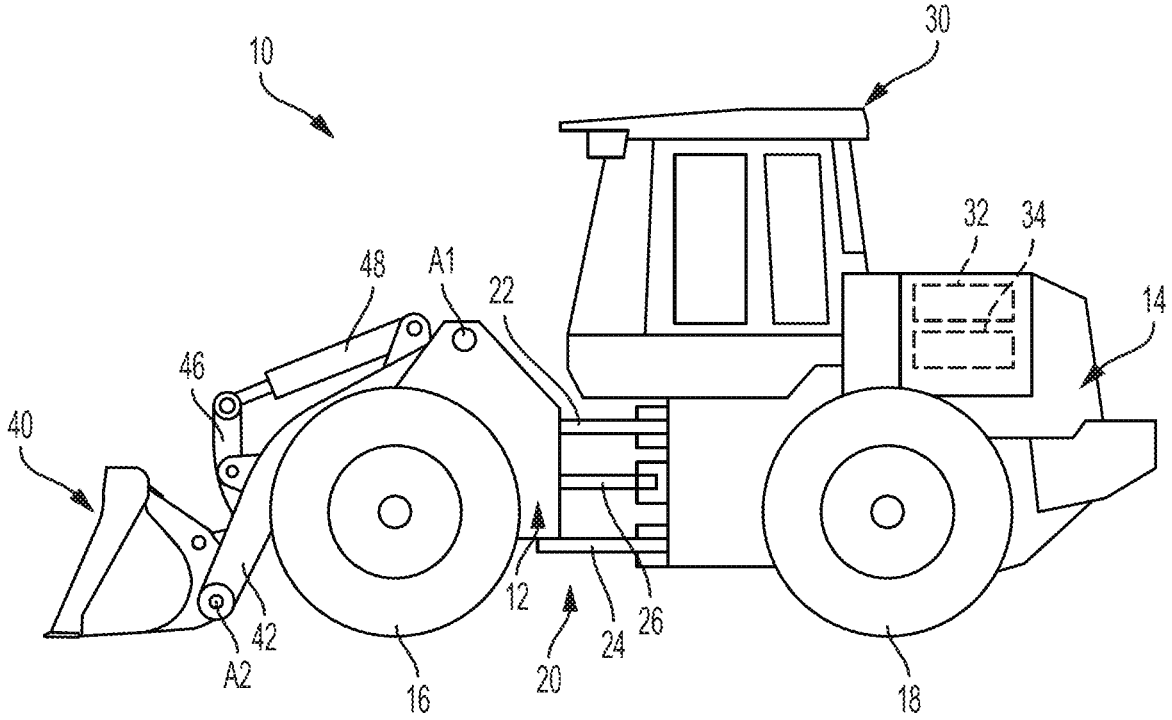
FIG. 1 is a side view of a four wheel drive loader 1 with an attachment in a first position.
Figure 2:
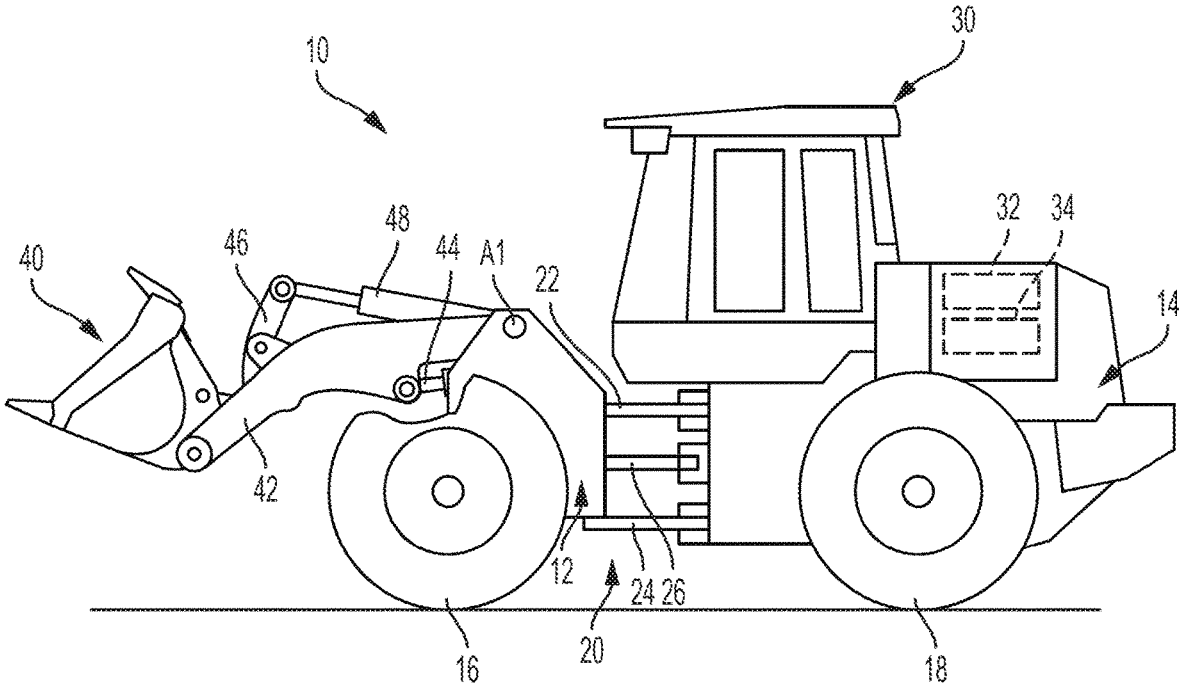
FIG. 2 is a side view of the four wheel drive loader of FIG. 1 with an attachment in a second position.

FIG. 1 shows a wheel loader 10 having a front body section 12 with a front frame and a rear body section 14 with a rear frame. The front body section 12 includes a set of front wheels 16 and the rear body section 14 includes a set of rear wheels 18, with one front wheel 16 and one rear wheel 18 positioned on each side of the loader 10. Different embodiments can include different ground engaging members, such as treads or tracks.

The front and rear body sections 12, 14 are connected to each other by an articulation connection 20 so front and rear body sections 12, 14 can pivot in relation to each other about a vertical axis (orthogonal to the direction of travel and the wheel axis). The articulation connection 20 includes one or more upper connection arms 22, one or more lower connection arms 24, and a pair of articulation cylinders 26 (one shown), with one articulation cylinder 26 on each side of the loader 10. Pivoting movement of the front body 12 is achieved by extending and retracting the piston rods in the articulation cylinders 26.

The rear body section 14 includes an operator cab 30 in which the operator controls the loader 10. A control system (not shown) is positioned in the cab 30 and can include different combinations of a steering wheel, control levers, joysticks, control pedals, and control buttons. The operator can actuate one or more controls of the control system for purposes of operating movement of the loader 10 and the different loader components. The rear body section 14 also contains a prime mover 32 and a control system 34. The prime mover 32 can include an engine, such as a diesel engine and the control system 34 can include a vehicle control unit (VCU).

A work implement 40 is moveably connected to the front body section 12 by one or more boom arms 42. The work implement 40 is used for handling and/or moving objects or material. In the illustrated embodiment, the work implement 40 is depicted as a bucket, although other implements, such as a fork assembly, can also be used. A boom arm 42 can be positioned on each side of the work implement 40. Only a single boom arm 42 is shown in the provided side views and referred to herein as the boom 42. The illustrated boom 42 is pivotably connected to the frame of the front body section 12 about a first pivot axis A1 and the illustrated work implement 40 is pivotably connected to the boom 42 about a second pivot axis A2.

As best shown in FIGS. 1-4, one or more boom hydraulic cylinders 44 are mounted to the frame of the front body section 12 and connect to the boom 42. Generally, two hydraulic cylinders 44 are used with one on each side connected to each boom arm, although the loader 10 may have any number of boom hydraulic cylinders 44, such as one, three, four, etc. The boom hydraulic cylinders 44 can be extended or retracted to raise or lower the boom 42 and thus adjust the vertical position of the work implement 40 relative to the front body section 12.

One or more pivot linkages 46 are connected to the work implement 40 and to the boom 42. One or more pivot hydraulic cylinders 48 are mounted to the boom 42 and connect to a respective pivot linkage 46. Generally, two pivot hydraulic cylinders 48 are used with one on each side connected to each boom arm, although the loader 10 may have any number of pivot hydraulic cylinders 48. The pivot hydraulic cylinders 48 can be extended or retracted to rotate the work implement 40 about the second pivot axis A2, as shown, for example, in FIGS. 3 and 4. In some embodiments, the work implement 40 may be moved in different manners and a different number or configuration of hydraulic cylinders or other actuators may be used.

Figure 5:
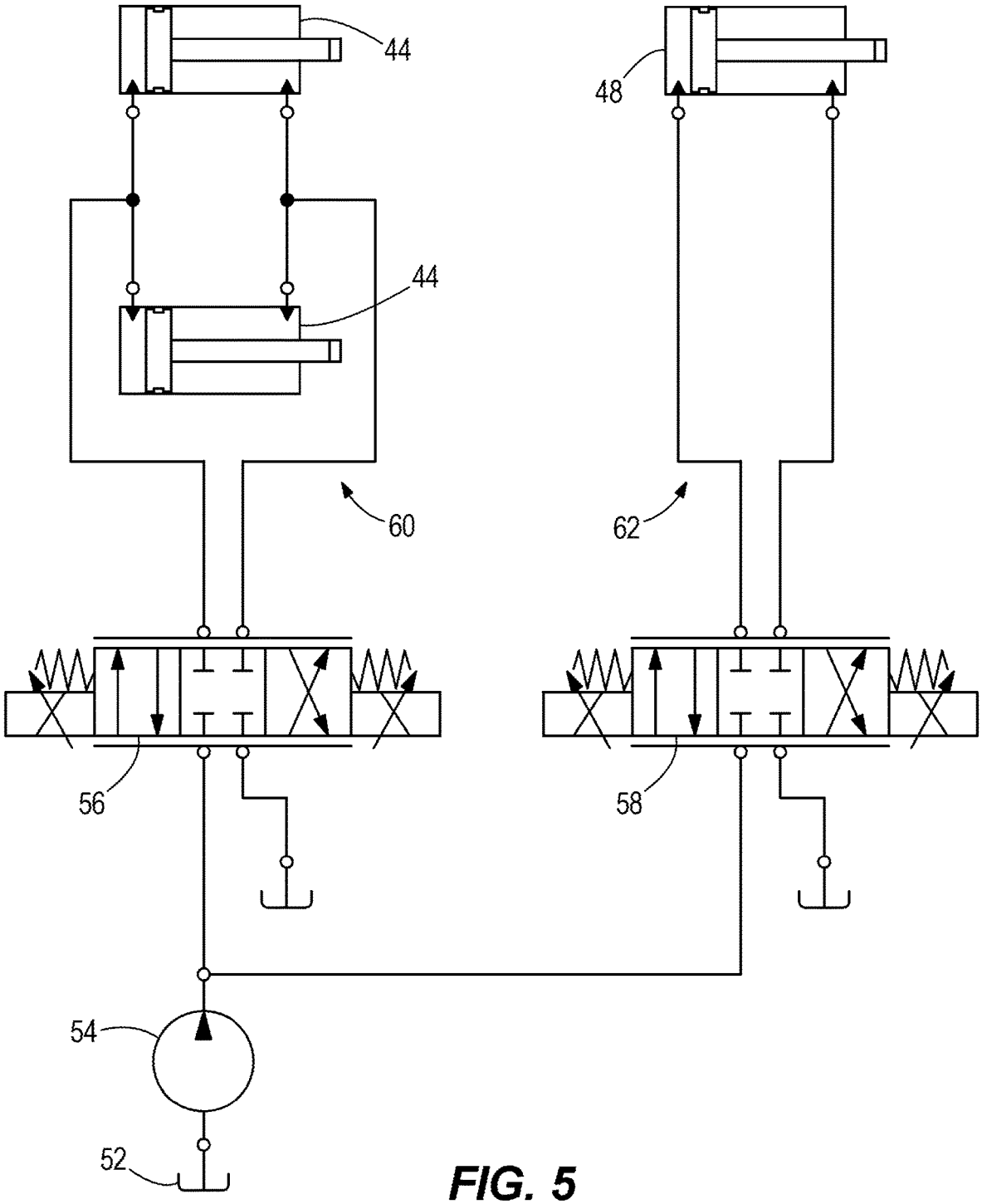
FIG. 5 is a schematic view of a portion of the hydraulic system of the attachment according to some embodiments.

FIG. 5 illustrates a portion of a hydraulic fluid circuit of the hydraulic cylinders 44 and 48. The hydraulic circuit includes a fluid reservoir 52, a pump 54, a first electrohydraulic control valve 56, a second electrohydraulic control valve 58, a first flow circuit 60, and a second flow circuit 62. The pump 54 directs fluid from the fluid reservoir 52 toward one or both of the first and second electrohydraulic control valves 56, 58.

The illustrated first electrohydraulic control valve 56 is a proportional control valve which can control a volume of fluid permitted to flow through the first valve 56. Therefore, in additional to fully open and fully closed, the first valve 56 has multiple intermediate positions that permit some fluid to flow through the first valve 56. The first valve 56 is fluidly positioned between the pump 54 and the first flow circuit 60. When the first valve 56 is either fully or partially open, the pump 54 moves fluid from the reservoir 52, through the first valve 56 into the first flow circuit 60. The illustrated first flow circuit includes two hydraulic cylinders 44 in parallel, but other quantities of hydraulic cylinders can be used. As discussed above, these hydraulic cylinders 44 are coupled to the front body section 12 and the boom 42 to pivot the boom 42 about the first pivot axis A1 (see FIGS. 1-4).

The illustrated second electrohydraulic control valve 58 is also a proportional control valve which can control a volume of fluid permitted to flow through the second valve 58. Therefore, in additional to fully open and fully closed, the second valve 58 has multiple intermediate positions that permit some fluid to flow through the second valve 58. The second valve 58 is fluidly positioned between the pump 54 and the second flow circuit 62. When the second valve 58 is either fully or partially open, the pump 54 moves fluid from the reservoir 52, through the second valve 58 into the second flow circuit 62. The illustrated second flow circuit includes one hydraulic cylinder 48, but other quantities of hydraulic cylinders can be used. As discussed above, this hydraulic cylinder 48 is coupled to the boom 42 and a pivot linkage 46 to pivot the work implement 40 about the second pivot axis A2 (see FIGS. 1-4).

Figure 3:
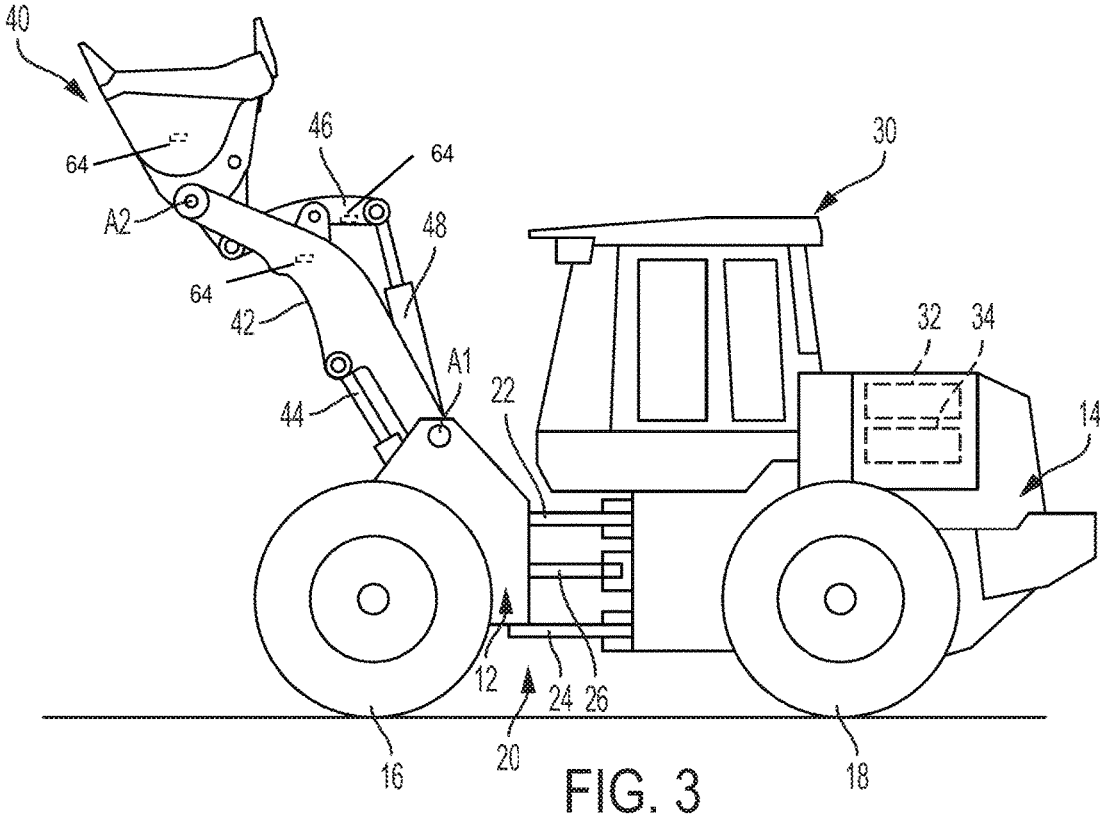
FIG. 3 is a side view of the four wheel drive loader of FIGS. 1 and 2 with the attachment in a third position.
Figure 4:
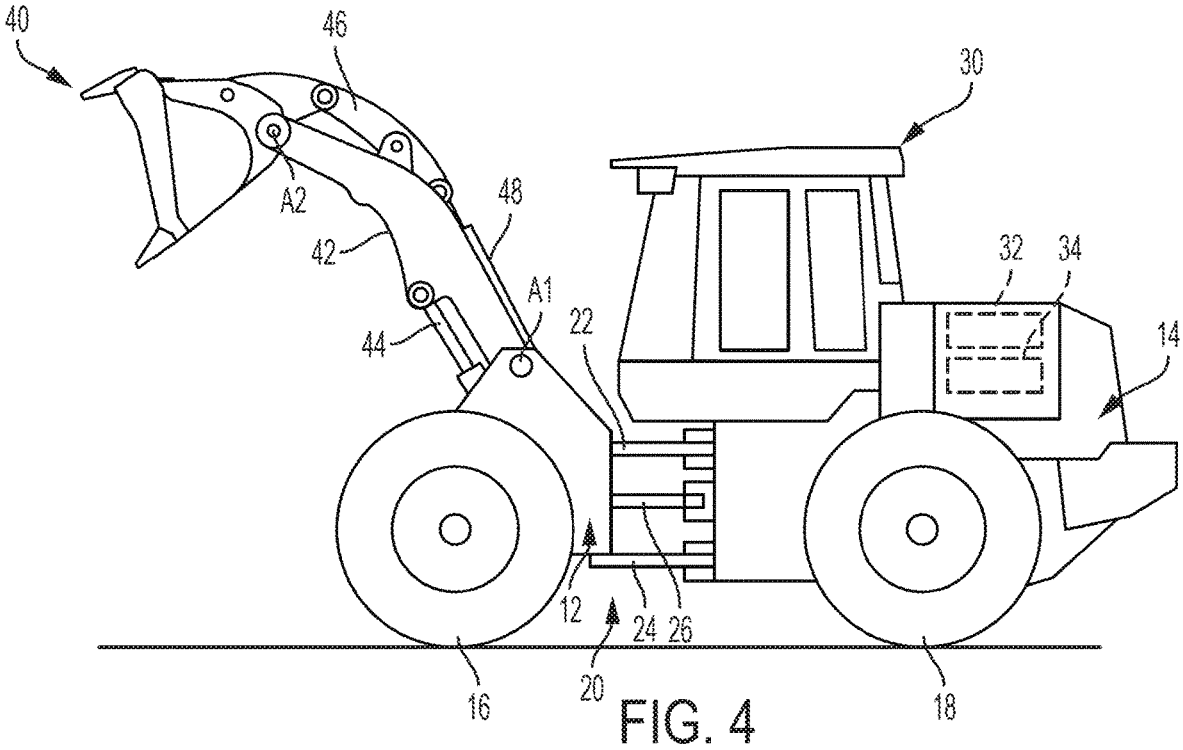
FIG. 4 is a side view of the four wheel drive loader of FIGS. 1-3 with the attachment in a fourth position.

In some embodiments, one or more accelerometers 64 are positioned on the wheel loader 10. FIG. 3 illustrates a few possible locations for accelerometers 64. For example, one or more accelerometers 64 can be mounted on the pivot linkage 46, on the boom 42 and/or on the work implement 40. One or more of these accelerometers 64 are utilized to sense an acceleration of the work implement 40 and to adjust a flow to the hydraulic cylinders 44 through the first electrohydraulic control valve 56 accordingly. For example, if a relatively light work implement is coupled to the boom 42, then the acceleration sensed by the accelerometers during an impact (i.e., at the end of a stroke or at a structural contact) would be relatively small and the fluid could be permitted to flow through the first electrohydraulic control valve 56 freely. If a relatively heavy work implement is coupled to the boom 42, then the acceleration sensed by the accelerometers during an impact would be relatively large and the fluid flow through the first electrohydraulic control valve 56 should be limited to a degree. Further, if a somewhat heavy work implement is coupled to the boom 42, a somewhat large acceleration would be sensed by the accelerometers during an impact and the fluid flow through the first electrohydraulic control valve 56 should be somewhat limited. If a very heavy work implement is coupled to the boom 42, a very large acceleration would be sensed by the accelerometers during an impact and the fluid flow through the first electrohydraulic control valve 56 should be limited to a greater degree than for the somewhat heavy work implement.

Figure 6:
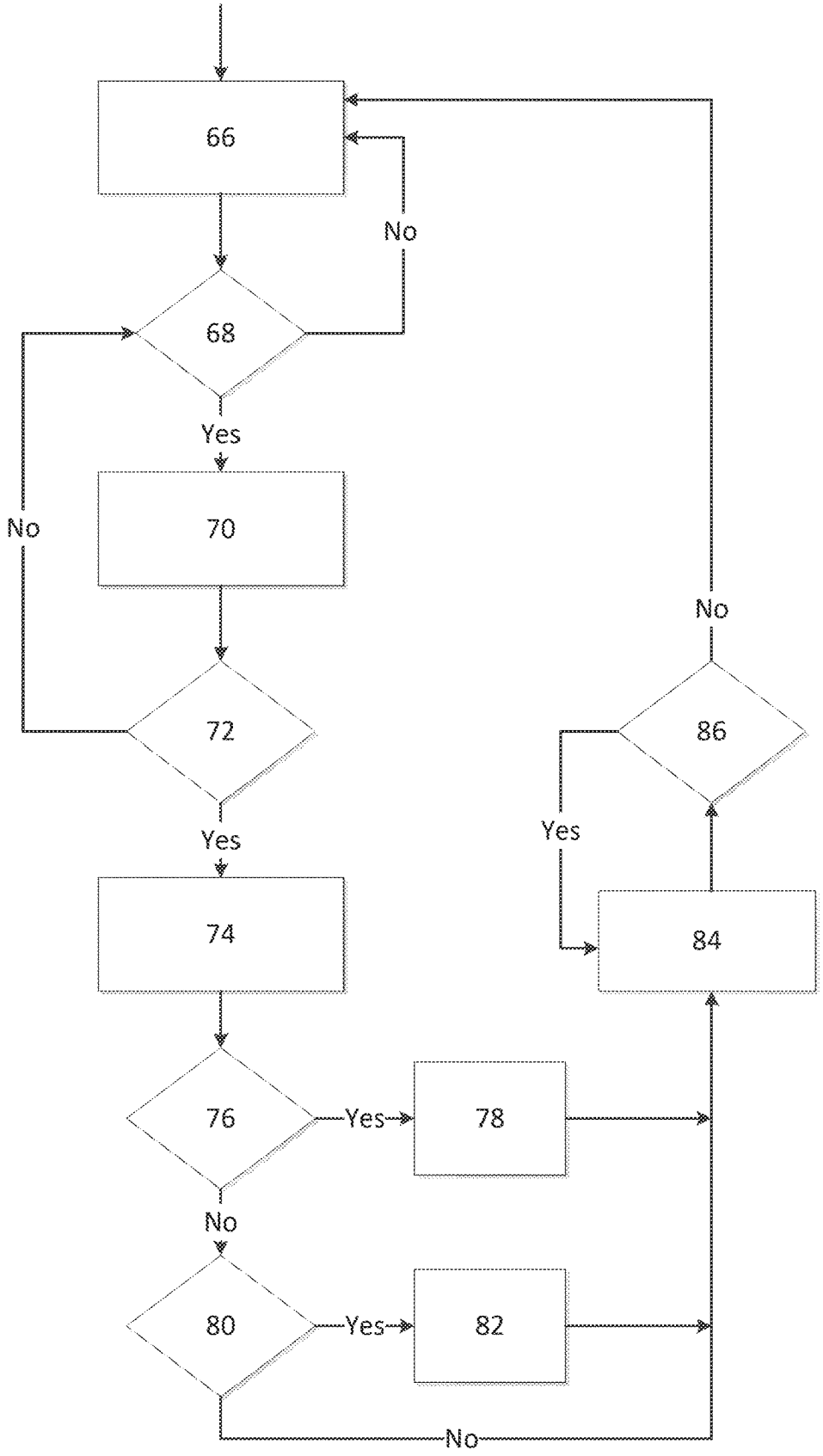
FIG. 6 is a flow chart illustrating one possible mode of operation of the four wheel drive loader.

FIG. 6 illustrates one possible mode of operation of the wheel loader 10. At step 66, the operator work implement command is observed. At step 68, the control system 34 determines if the work implement 40 is empty (i.e., is a bucket or a fork holding any material). If the work implement 40 is empty, operation moves to step 70, whereas if the work implement 40 is not empty, operation returns to step 66. At step 70, the position of the work implement 40 is observed. At step 72, the control system 34 determines if the work implement 40 is at the end of a stroke. If the work implement 40 is at the end of a stroke, operation moves to step 74, whereas if the work implement 40 is not at the end of a stroke, operation returns to step 68. At step 74, the control system 34 observes feedback from the one or more of the accelerometers 64. Steps 68, 70 and 72 ensure that the operator has emptied the work implement 40 and that the boom 42 is at the end of a stroke before an acceleration feedback from the one or more accelerometers 64 is observed by the control system 34 at step 74.

At step 76, the control system 34 determines if the accelerometer feedback is greater than the upper acceleration threshold. If the accelerometer feedback is greater than the upper acceleration threshold, operation moves to step 78 which reduces the flow rate permitted through the first electrohydraulic control valve 56. In order to limit impacts due to a relatively heavy work implement 40, the flow rate through the first electrohydraulic control valve 56 is decreased a pre-determined increment at step 78. If the accelerometer feedback is not greater than the upper acceleration threshold, operation moves to step 80. At step 80, the control system 34 determines if the accelerometer feedback is less than the lower acceleration threshold. If the accelerometer feedback is less than the lower acceleration threshold, operation moves to step 82 which increases the flow rate permitted through the first electrohydraulic control valve 56. In order to increase operator efficiency due to a relatively light work implement 40, the flow rate through the first electrohydraulic control valve 56 is increased a pre-determined increment at step 82. The pre-determined increments for increasing and decreasing the flow rate through the first electrohydraulic control valve 56 can be different. For example, the pre-determined increment for decreasing flow may be greater than the pre-determined increment for increasing flow.

If the accelerometer feedback is not less than the lower acceleration threshold, operation moves to step 84. At step 84, the control system 34 observes the position of the work implement 40. At step 86, the control system 34 determines if the work implement 40 is at the end of a stroke. If the work implement 40 is at the end of a stroke, operation returns to step 84. If the work implement 40 is not at the end of a stroke, operation returns to step 66. Before operation can return to step 66, the control system 34 ensures that the work implement 40 is moved away from the end of stroke (of step 72) prior to observing the accelerometer feedback and adjusting the flow rate through the first electrohydraulic control valve 56 again.

Other external forces can cause accelerations sensed by the accelerometers 64. Some external forces can include ground speed, travel of the boom 42, brake actuation, driving over rough terrain or driving into objects (such as a material pile). Accelerations caused by these external forces can be measured and averaged over time or can be measured prior to utilizing the operating mode of FIG. 6 and then accounted for at steps 76 and 80 of FIG. 6. Thus, the mode of operation of FIG. 6 isolates the accelerations caused by the implement size.

Figure 7:
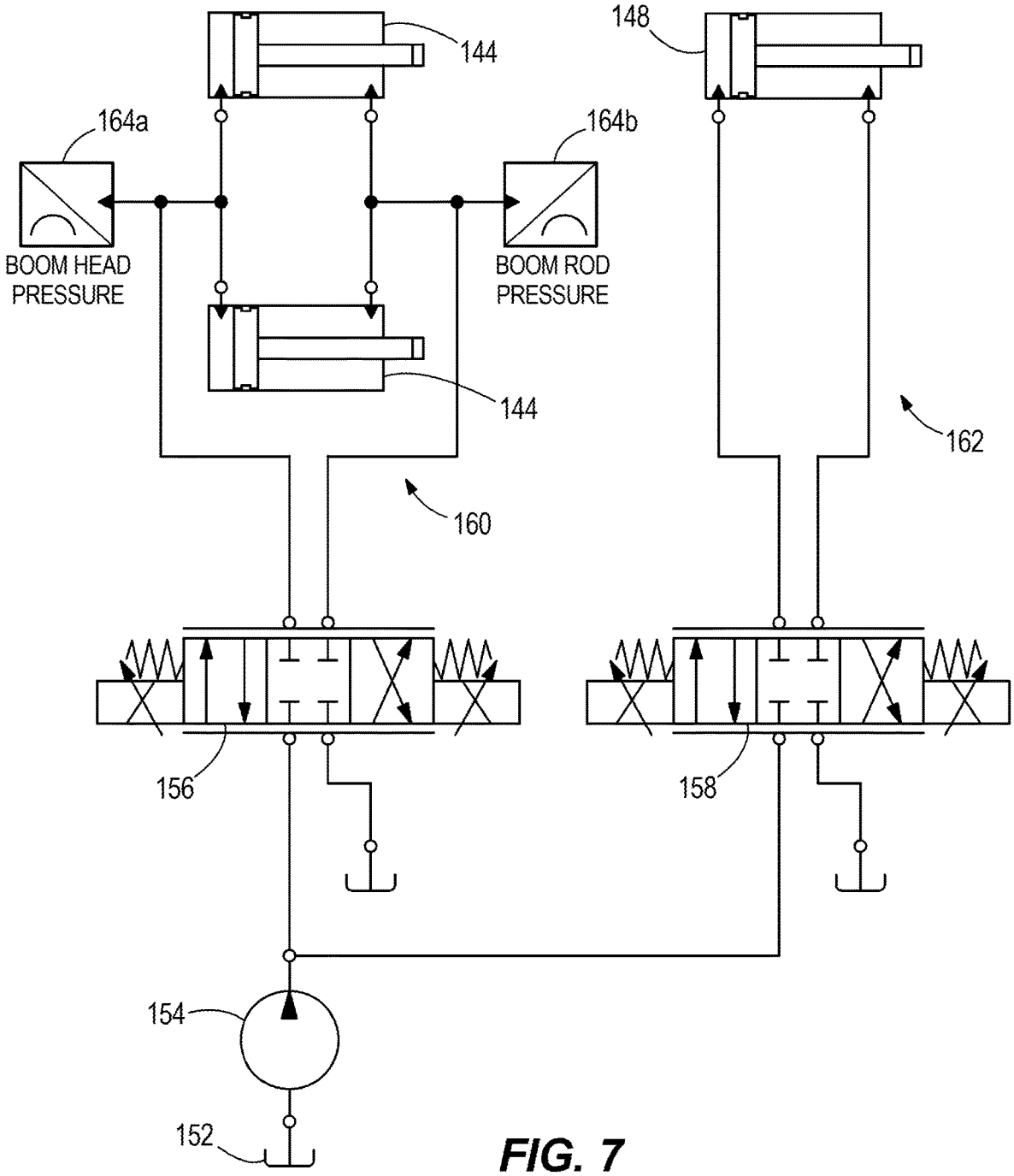
FIG. 7 is a schematic view of a portion of the hydraulic system of the attachment according to some embodiments.
Figure 8:
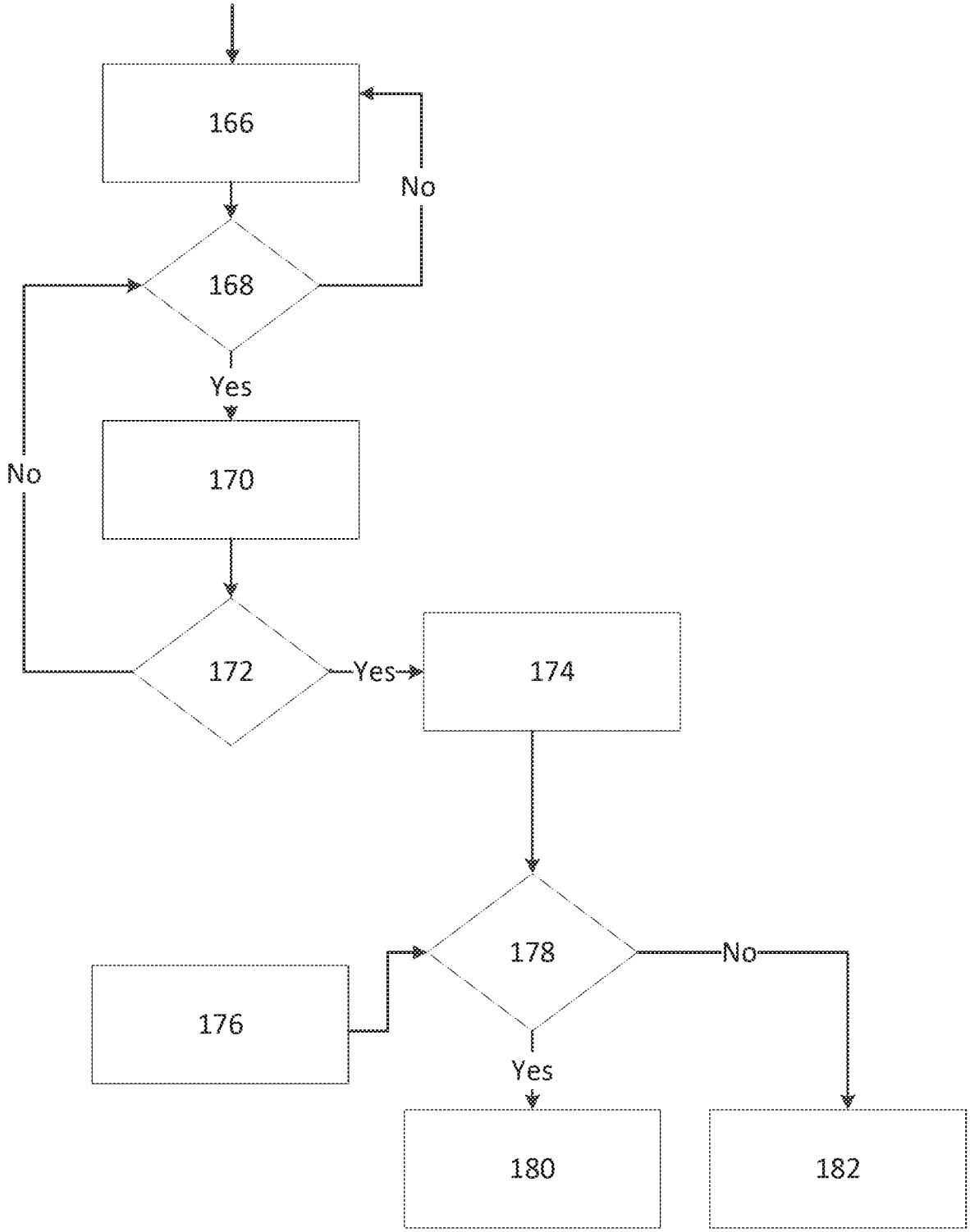
FIG. 8 is a flow chart illustrating one possible mode of operation of the four wheel drive loader.
Figure 9:
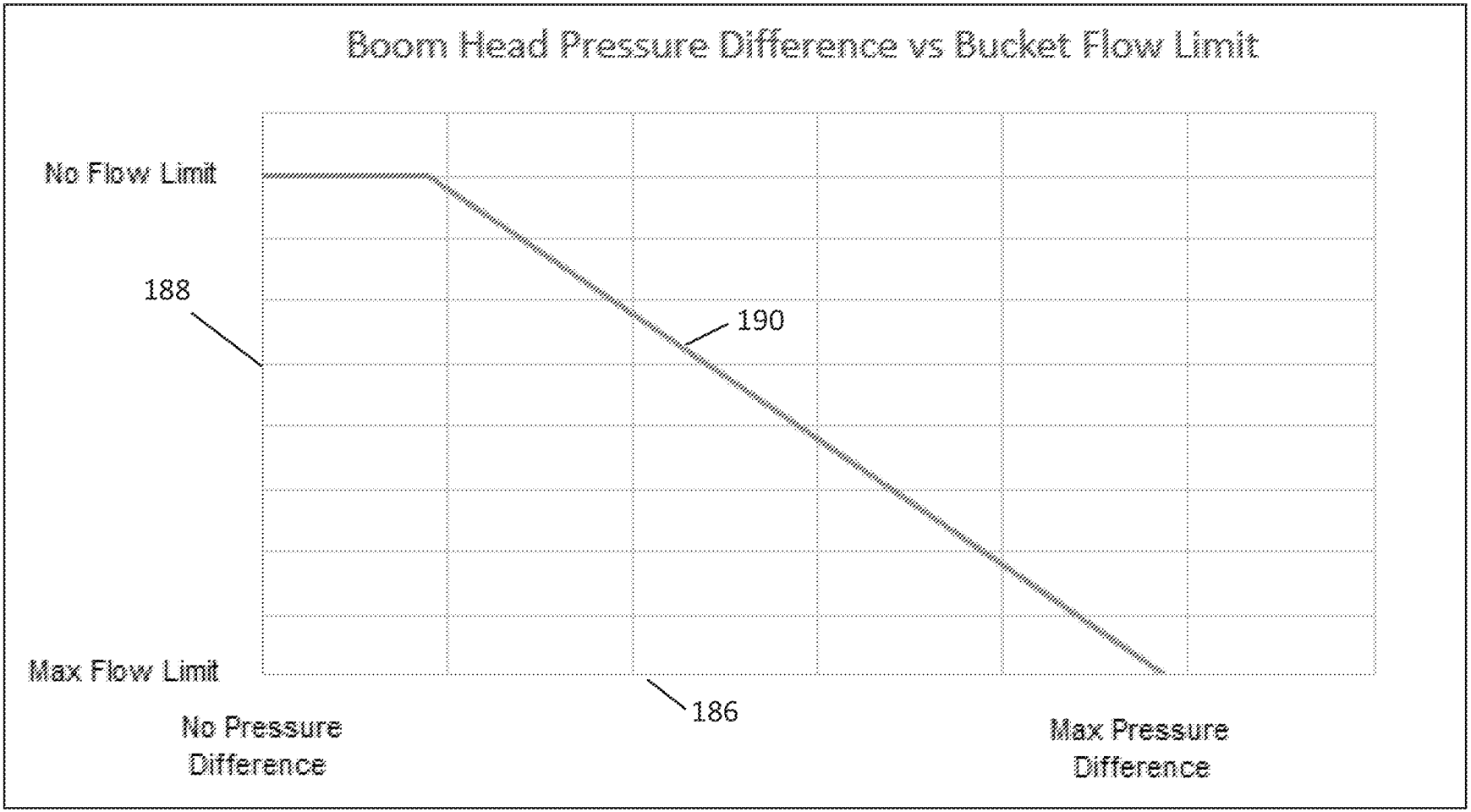
FIG. 9 is a graph illustrating a flow limit calculation based upon a pressure difference.

FIGS. 7-9 illustrate another possible embodiment of a hydraulic fluid system that can be utilized with the wheel loader 10 of FIGS. 1-4. Reference numbers are in the "100" series with corresponding numbers referring to corresponding elements of the embodiment illustrated in FIGS. 5 and 6.

FIG. 7 illustrates a portion of a hydraulic fluid circuit of hydraulic cylinders 144 and 148. The hydraulic circuit includes a fluid reservoir 152, a pump 154, a first electrohydraulic control valve 156, a second electrohydraulic control valve 158, a first flow circuit 160, and a second flow circuit 162. The pump 154 directs fluid from the fluid reservoir 152 toward one or both of the first and second electrohydraulic control valves 156, 158.

The illustrated first electrohydraulic control valve 156 is a proportional control valve which can control a volume of fluid permitted to flow through the first valve 156. Therefore, in additional to fully open and fully closed, the first valve 156 has multiple intermediate positions that permit some fluid to flow through the first valve 156. The first valve 156 is fluidly positioned between the pump 154 and the first flow circuit 160. When the first valve 156 is either fully or partially open, the pump 154 moves fluid from the reservoir 152, through the first valve 156 into the first flow circuit 160. The illustrated first flow circuit includes two hydraulic cylinders 144 in parallel, but other quantities of hydraulic cylinders can be used. As discussed above, these hydraulic cylinders 144 are coupled to the front body section 12 and the boom 42 to pivot the boom 42 about the first pivot axis A1 (see FIGS. 1-4).

The illustrated second electrohydraulic control valve 158 is also a proportional control valve which can control a volume of fluid permitted to flow through the second valve 158. Therefore, in additional to fully open and fully closed, the second valve 158 has multiple intermediate positions that permit some fluid to flow through the second valve 158. The second valve 158 is fluidly positioned between the pump 154 and the second flow circuit 162. When the second valve 158 is either fully or partially open, the pump 154 moves fluid from the reservoir 152, through the second valve 158 into the second flow circuit 162. The illustrated second flow circuit includes one hydraulic cylinder 148, but other quantities of hydraulic cylinders can be used. As discussed above, this hydraulic cylinder 148 is coupled to the boom 42 and a pivot linkage 46 to pivot the work implement 40 about the second pivot axis A2 (see FIGS. 1-4).

In the embodiment of FIGS. 7-9, a first pressure sensor 164*a* configured to sense a boom head pressure and a second pressure sensor 164*b* is configured to sense a boom rod pressure. The pressure sensors 164*a*, 164*b* are utilized to sense a pressure of the hydraulic fluid in the boom hydraulic cylinders 144 and to adjust a flow to the hydraulic cylinders 144 through the first electrohydraulic control valve 156 accordingly. The pressure of the hydraulic fluid in the boom hydraulic cylinders 144 corresponds to a weight of the work implement 40 attached to the boom 42. For example, if a relatively light work implement is coupled to the boom 42, then the pressure sensed by the pressure sensors 164*a*, 164*b* while the work implement is lifted would be relatively small and the fluid could be permitted to flow through the first electrohydraulic control valve 156 freely. If a relatively heavy work implement is coupled to the boom 42, then the pressure sensed by the pressure sensors 164*a*, 164*b* while the work implement is lifted would be relatively large and the fluid flow through the first electrohydraulic control valve 156 should be limited to a degree. Further, if a somewhat heavy work implement is coupled to the boom 42, a somewhat large pressure would be sensed by the pressure sensors 164*a*, 164*b* while the work implement is lifted and the fluid flow through the first electrohydraulic control valve 56 should be somewhat limited. If a very heavy work implement is coupled to the boom 42, a very large pressure would be sensed by the pressure sensors 164*a*, 164*b* while the work implement is lifted and the fluid flow through the first electrohydraulic control valve 156 should be limited to a greater degree than for the somewhat heavy work implement.

FIG. 8 illustrates one possible mode of operation of the wheel loader 10 with the hydraulic fluid circuit of FIG. 7. The mode of operation of FIG. 8 begins at step 166 by instructing the operator to dump any material from the work implement and to lower the boom. At step 168, the control system confirms that the boom is lowered to a stop. If the boom is lowered to a stop at step 168, operation moves to step 170. If the boom is not lowered to a stop at step 168, operation moves back to step 166. Steps 166 and 168 confirm that the work implement is empty (i.e., with no material in a bucket or no load on a fork) and that the boom is in a position in which is can be slowly raised. At step 170, the operator is instructed to start raising the boom. At step 172, the control system confirms if the boom is being raised. If the boom is being raised, operation moves to step 174. If the boom is not being raised, operation returns to step 168. At step 174, the boom head pressure is observed while the boom is being raised. At step 176, the flow limit is calculated (described in detail in below regarding FIG. 9). Both the observed boom head pressure from step 174 and the calculated flow limit from step 176 are input into the control system. At step 178, the control system determines if the sensed head pressure is greater than the baseline pressure. The baseline pressure could be established as a constant value that is set during manufacturing or could be calibrated in the field when no work implement is attached to the boom. The baseline pressure corresponds to the pressure when no work implement is coupled to the boom. If the sensed pressure is greater than the baseline pressure, a bucket dump flow limit is set at step 180. If the sensed pressure is not greater than the baseline pressure, the bucket dump flow limit is removed. The bucket dump flow limit is applied to the second electrohydraulic control valve 158 to limit flow to the hydraulic cylinder 148 to thereby control the speed that the work implement is tilted.

FIG. 9 illustrates a graph that determines the flow limit of step 176. The graph includes an x-axis 186 that indicates a difference between a sensed pressure and the baseline pressure. The position on the x-axis 186 corresponds to a load imposed by the current work implement. The graph also includes a y-axis 188 that indicates a flow limit that extends from no flow limit (unimpeded flow) and a maximum flow limit (very restricted flow). The flow limit line 190 indicates the relationship between the pressure difference and the flow limit that is imposed in step 178. As shown in FIG. 9, the bucket dump flow limit is proportional to the difference between the sensed boom head pressure and the baseline pressure. The greater the difference between the sensed pressure and the baseline pressure, the greater the flow limit that is implemented.

Figure 10:
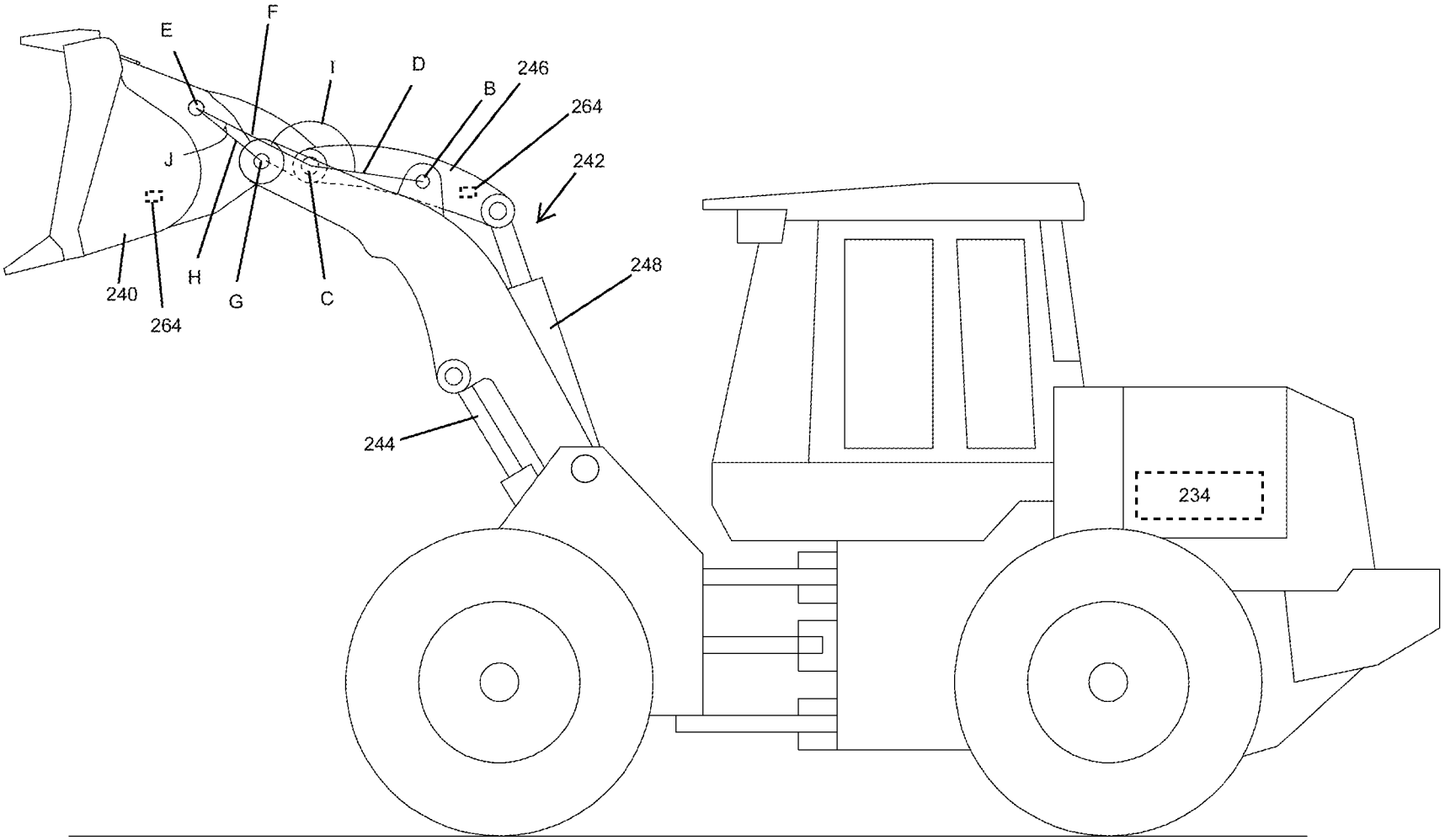
FIG. 10 is a side view of the four wheel drive loader according to some embodiments.
Figure 11:
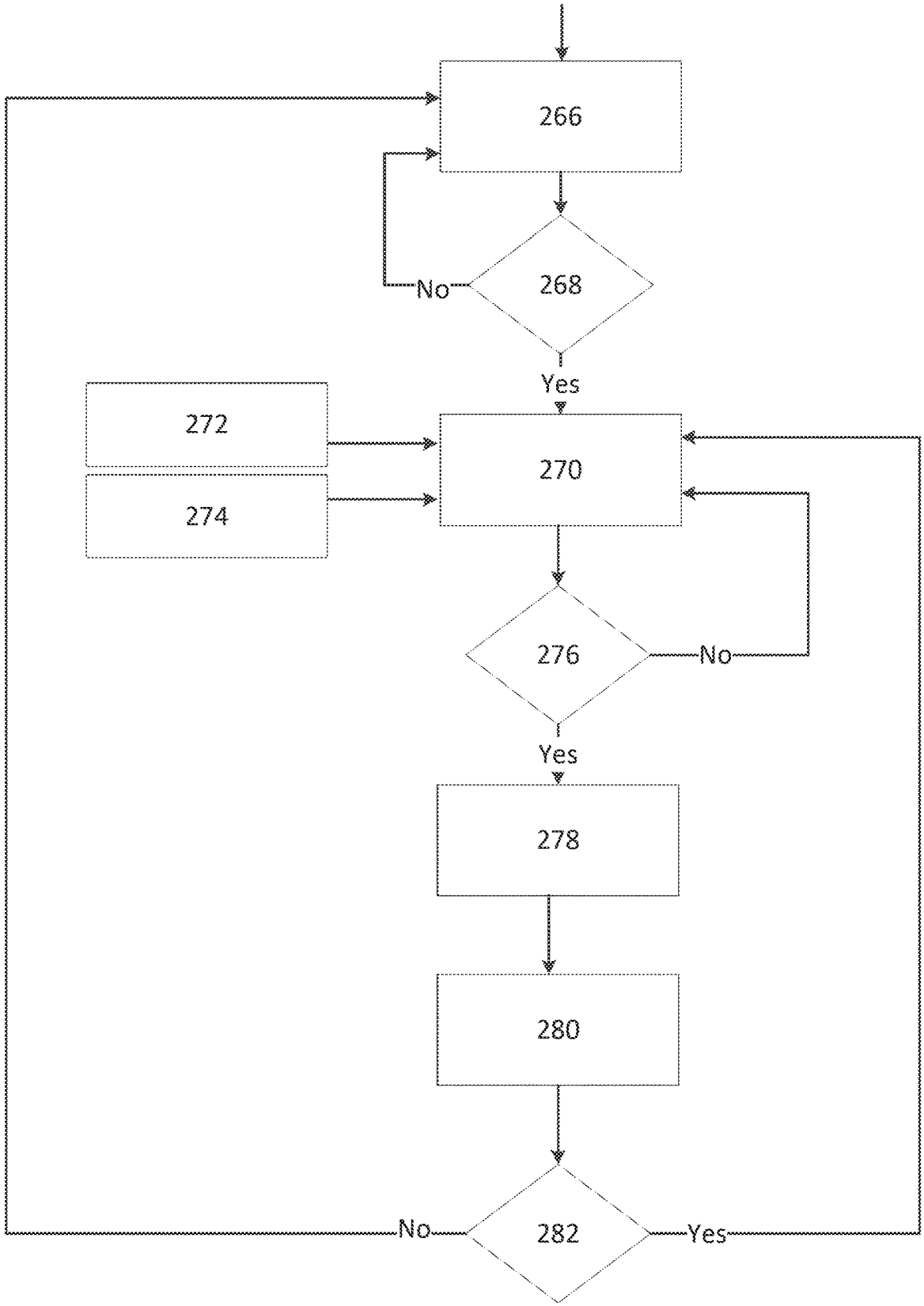
FIG. 11 is a flow chart illustrating one possible mode of operation of the four wheel drive loader.

FIGS. 10 and 11 illustrate another possible embodiment of a hydraulic fluid system that can be utilized with the wheel loader 10 of FIGS. 1-4. Reference numbers are in the "200" series with corresponding numbers referring to corresponding elements of the embodiments illustrated in FIGS. 1-9.

FIG. 10 shows angles between a work implement 240, a boom 242 and a pivot linkage 246. The illustrated work implement 240 is a bucket, but other work implements can be utilized in place of the bucket. The boom 242 has a plurality of axes of rotation that are illustrated in FIG. 10. Axes B and C define a first line D extending between the axes B and C. Axes C and E define a second line F extending between the axes C and E. A first angle I extends between the first line D and the second line F. Axes E and G define a third line H extending between axes E and G. A second angle J extends between the second line F and the third line H. The control system can create a soft stop to limit the first angle I to less than or equal to 165 degrees to inhibit the work implement 240 from moving over center. If the work implement 240 moves over center, retuning the work implement 240 to a curled state (such as the position shown in FIG. 3) would be difficult. The control system can create a soft stop to inhibit movement of the work implement 240 to a location at which the first angle I is greater than 165 degrees. Further, the work implement 240 can be inhibited from pivoting past the second angle J being 15 degrees. Specifically, the second angle J can be maintained at or above 15 degrees to inhibit the work implement 240 from moving over center.

FIG. 10 also illustrates two possible locations of a first sensor 264 that is configured to sense a velocity of the work implement 240 and is configured to communicate the sensed velocity with a control system 234. One of the illustrated first sensors 264 is positioned on the pivot linkage 246 and another of the illustrated first sensors 264 is positioned on the work implement 240. In some embodiments, the first sensor 264 can be positioned on the work implement 240. In some embodiments, more than one sensor can be utilized to sense the velocity of the work implement 240 and an average velocity of the sensors can be utilized as the sensed velocity. In other embodiments, only one first sensor is utilized. In some embodiments, the first sensor is a position sensor, whereas in other embodiments, the first sensor is an accelerometer. A second sensor is utilized to sense a weight of the work implement 240 and to communicate the sensed weight to the control system 234. The second sensor can include one or more pressure sensors configured to sense a pressure of fluid in one or both hydraulic cylinders 244, 248. The sensed weight of the attachment can be used to obtain an approximate kinetic energy of the attachment. In some embodiments, the sensed weight in combination with the center of gravity of the attachment can be used to approximate the kinetic energy of the attachment.

FIG. 11 illustrates one possible mode of implementing the soft stops at the angles shown in FIG. 10. At step 266, the control system evaluates an operator's command of the work implement 240. At step 268 the control system determines if the work implement 240 is being commanded to empty any load being carried. If the control system determines that the work implement 240 is being commanded to empty, operation moves to step 270. If the control system determines that the work implement 240 is not being commanded to empty, operation returns to step 266. At step 270, the control system receives input from steps 272 and 274. Step 272 involves calibrating an inertia of the work implement 240 and step 274 involves calibrating a rotational velocity of the work implement 240. Step 270 includes calculating a kinetic energy of the work implement 240. The kinetic energy is a function of the rotational velocity and the inertia of the work implement 240. Step 276 compares the calculated kinetic energy to a threshold kinetic energy. If the calculated kinetic energy is greater than the threshold kinetic energy, operation moves to step 278. If the calculated kinetic energy is not greater than the threshold kinetic energy, operation returns to step 270.

At step 278, minimum toggle angles for the work implement 240 are determined. Operation then moves to step 280 at which minimum travel angles are set within the control software. These minimum toggle angles and minimum control angles can correspond to the first angle I and the second angle J of FIG. 10. Specifically, the minimum toggle angles and minimum control angles correspond to soft stops that are set for the first angle I and the second angle J in FIG. 10. The minimum toggle angles and the minimum control angles represent the extent to which the work implement can travel without moving the linkage elements over center. Operation then moves to step 282 at which the control system determines if the work implement 240 is being commanded to empty. If the work implement 240 is being commanded to empty, operation moves to step 270. If the work implement 240 is not being commanded to empty, operation returns to step 266.

The control system can create soft stops to be used in place of or in addition to the physical dump stops that are set by the factory to prevent the boom and work implement from moving over center which could cause a lack of stability. In some situations (i.e., with a light and/or small work implement) the boom and work implement will have increased mobility because the work implement may be moved to more locations without compromising the stability of the vehicle.

In some embodiments, the soft stop locations are determined by the maximum dump angle calculated based upon the inertia of the work implement. In some embodiments, the soft stop locations are determined by the weight of the attachment. The weight of the attachment can be measured by measuring the head end pressure of the boom cylinder. A flow rate to one or both of the cylinders 44 and 48 can be limited while a sensed weight is above a set weight. The flow rate could be limited during the entire operation or may only be limited near an end of stroke for either or both of the cylinders 44 and 48.

Figure 12:
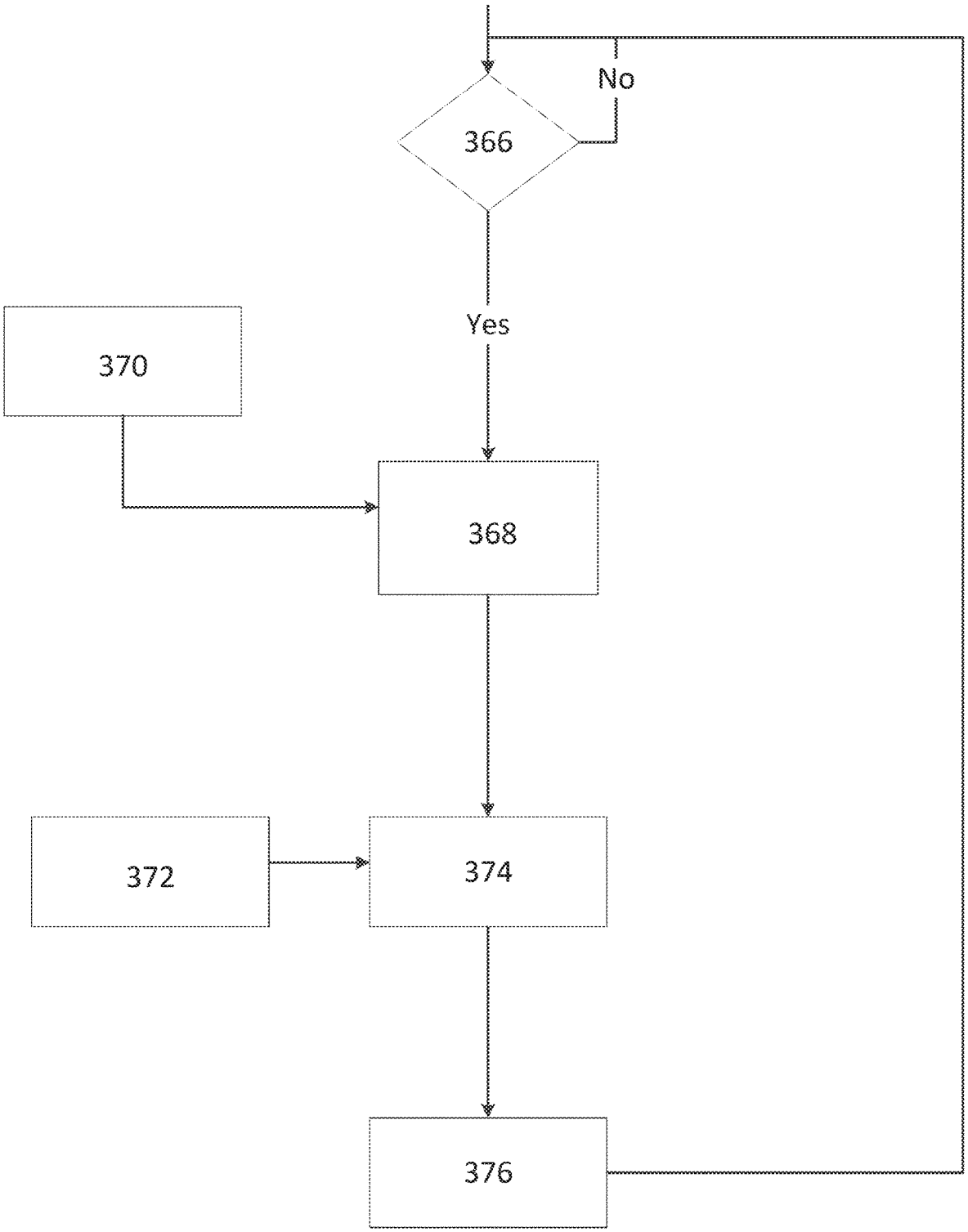
FIG. 12 is a flow chart illustrating one possible mode of operation of the four wheel drive loader.
Figure 13:
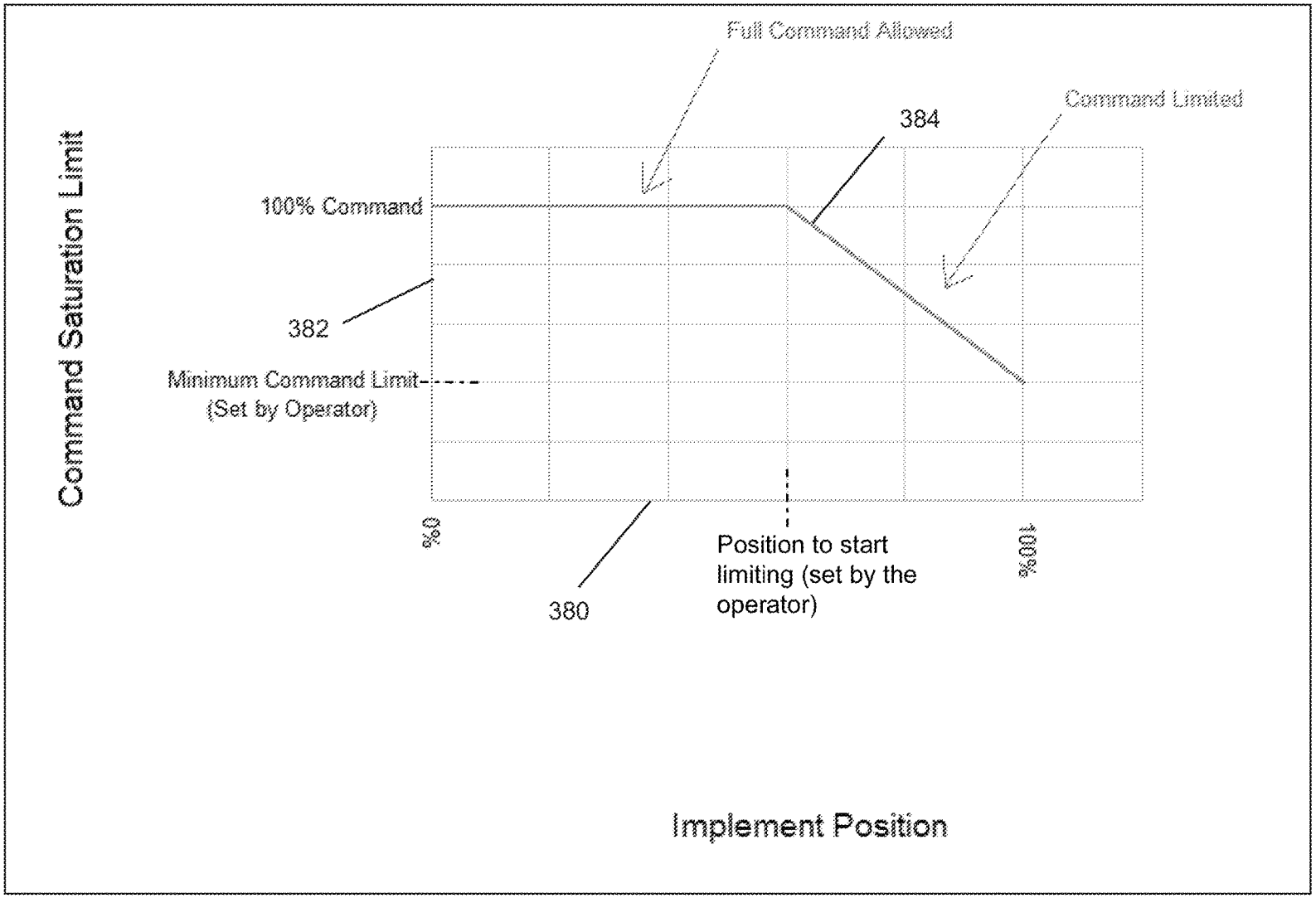
FIG. 13 is a graph illustrating one of the steps of FIG. 12.

FIGS. 12 and 13 illustrate a possible alternative that can be utilized with any of the embodiments disclosed herein. FIG. 12 is a flow chart illustrating one possible mode of operation in which an operator can adjust the firmness of the stops at the end of stroke on the cylinders 44 and 48. These stops can be adjusted between a hard stop in which no deceleration of the cylinders 44 and 48 occurs prior to an end of stroke, and a soft stop in which a variable amount of deceleration of the cylinders 44 and 48 occurs prior to an end of stroke. In some circumstances, a soft stop would impair operation of the vehicle, such as when an operator is trying to knock material out of the work implement. In other circumstances, hard stops can be uncomfortable for the operator and potentially damaging the vehicle.

FIGS. 12 and 13 illustrate an embodiment in which an operator can either enable or disable soft stops during operation. Further, an intensity of the soft stops can be adjusted within a range of acceptable values. The control system can be used to determine an acceptable maximum impact force to be allowed to avoid damaging the vehicle. There are two factors that are adjusted to adjust the intensity of the soft stops. The first factor is the position at which the work implement should begin to slow down. The second factor is the extent to which the work implement is slowed down before stopping. In some embodiments, the operator can adjust these two factors separately. In other embodiments, the operator can set a desired soft stop intensity level and the control system can calculate the first and second factors based upon the desired soft stop intensity level.

FIG. 12 shows a flow chart in which the control system determines if the operator is commanding the work implement at step 366. If the operator is commanding the work implement, operation moves to step 368. If the operator is not commanding the work implement, operation remains at step 366. Step 368 receives input from the controller at step 370 which indicates a position of the implement. Step 370 can be accomplished by a position sensor or any other known sensor for sensing a position and communicating the position to the control system. Step 368 calculates a command saturation limit based upon a position of the implement. A table showing the calculation for obtaining the command saturation limit is shown in FIG. 13.

Step 372 involves obtaining input from the operator when the operator selects the desired soft stop sensitivity. Step 374 receives the command saturation limit from step 368 and the operator input from step 372 and applies the command saturation limit of step 368 with the operator input from step 372 to determine a saturated operator command. At step 376, the implement control valve is set to the saturated operator command from step 374. Then, operation returns to step 366.

As shown in FIG. 13, an implement position to start limiting a speed of the work implement is shown along axis 380. A minimum command limit is shown along axis 382. A line 384 extends along the command saturation which is a function of the implement positon and the command saturation limit set by the operator.

The adjustable soft stop feature can be utilized in combination with any of the embodiments disclosed herein to permit an operator to adjust the impact force based upon the specific situation and expected performance of the vehicle.

Various features and advantages of the disclosure are set forth in the following claims.

What is claimed is:

1. A material handling vehicle comprising:

a vehicle frame;

a boom arm having a first end and a second end, the boom arm coupled to the frame adjacent the first end for rotation with respect to the frame;

an actuator coupled to the vehicle frame and the boom arm for moving the boom arm with respect to the frame;

an attachment coupled to the boom arm adjacent the second end of the boom arm;

a fluid reservoir fluidly coupled to the actuator to control movement of the attachment;

a control system configured to direct movement of the attachment in response to input from a user;

a control valve positioned between the fluid reservoir and the actuator to selectively limit flow to the attachment and to thereby control a speed of movement of the attachment; and an accelerometer coupled to the vehicle and configured to sense an acceleration of the attachment and to communicate the sensed acceleration to the control system, wherein the control system is operable to compare the sensed acceleration to a pre-determined range of acceleration limits of the attachment, and wherein the control system is operable to adjust the control valve to limit flow to the actuator in response to the sensed acceleration of the attachment being above a pre-determined upper limit of the range of acceleration limits.

2. The material handling vehicle of claim 1, wherein the control system is operable to adjust the control valve to increase flow to the actuator in response to the sensed acceleration of the attachment being below a pre-determined lower limit of the range of acceleration limits.

3. The material handling vehicle of claim 1, wherein the sensed acceleration corresponds to a weight of the attachment.

4. The material handling vehicle of claim 1, wherein the accelerometer is mounted to one of the boom arm or the attachment.

5. The material handling vehicle of claim 1, wherein the accelerometer feedback is sensed while the actuator is at an end of stroke and while the attachment is empty.

6. The material handling vehicle of claim 1, wherein the control system is operable to adjust the control valve to inhibit movement of the attachment in response to the sensed acceleration of the attachment being above the pre-determined upper limit.

7. A method of controlling hydraulic fluid flow to an implement of a material handling vehicle, the method comprising:

coupling a boom arm to a vehicle frame for rotation about the vehicle frame;

rotating the boom arm with respect to the vehicle frame with an actuator;

coupling an attachment to the boom arm for rotation with respect to the boom arm;

sensing an acceleration of the attachment;

removing material from the attachment prior to sensing the acceleration of the attachment;

communicating the sensed acceleration of the attachment to a control system;

comparing the sensed acceleration to a pre-determined range of acceleration limits of the attachment, and limiting fluid flow to the actuator with a control valve in response to the sensed acceleration of the attachment being above a pre-determined upper limit of the range of acceleration limits.

8. The method of claim 7, further comprising increasing fluid flow to the actuator with the control valve in response to the sensed acceleration of the attachment being below a pre-determined lower limit of the range of acceleration limits.

9. The method of claim 7, wherein sensing the acceleration of the attachment corresponds to measuring a weight of the attachment.

10. The method of claim 7, further comprising mounting an accelerometer to one of the boom arm and the attachment prior to sensing the acceleration of the attachment.

11. The method of claim 7, further comprising moving the actuator to an end of stroke prior to sensing the acceleration of the attachment.

12. The method of claim 7, further comprising inhibiting movement of the attachment in response to the sensed acceleration of the attachment being above the pre-determined acceleration upper limit.

13. A control system for a material handling vehicle having a boom arm coupled to a vehicle frame for rotation about the vehicle frame, an actuator coupled to the vehicle frame and the boom arm to cause the boom arm to rotate about the vehicle frame, and an attachment coupled to the boom arm for rotation with respect to the boom arm, the control system comprising:

a controller configured to calculate a pre-determined range of acceleration limits of the attachment, and a sensor configured to sense an acceleration of the attachment and to communicate the sensed acceleration to the controller, wherein the sensed acceleration of the attachment corresponds to a weight of the attachment, and wherein the controller is configured to compare the pre-determined range of acceleration limits of the attachment to the sensed acceleration of the attachment and is configured to adjust a control valve to limit flow to the actuator in response to the sensed acceleration of the attachment being greater than the pre-determined range of acceleration limits.

14. The control system of claim 13, wherein the controller is configured to adjust a control valve to increase flow to the actuator in response to the sensed acceleration of the attachment being less than the pre-determined range of acceleration limits.

15. The control system of claim 13, wherein the sensor is an accelerometer and the accelerometer is coupled to one of the boom arm and the attachment prior to sensing the acceleration of the attachment.

16. The control system of claim 13, wherein the accelerometer feedback is sensed while the actuator is at an end of stroke.

17. The control system of claim 16, wherein the accelerometer feedback is sensed while the attachment is empty.

18. The control system of claim 13, wherein the control system is operable to adjust the control valve to limit a range of movement of the attachment in response to the sensed acceleration of the attachment being greater than the pre-determined range of acceleration limits.

* * * * *